US009114062B1

(12) United States Patent
McGee

(10) Patent No.: US 9,114,062 B1
(45) Date of Patent: Aug. 25, 2015

(54) BOTTLE WITH VOLUMETRIC DISPLACEMENT MEANS

(76) Inventor: Jessica A. McGee, El Paso, TX (US)

( * ) Notice: Subject to any disclaimer, the term of this patent is extended or adjusted under 35 U.S.C. 154(b) by 567 days.

(21) Appl. No.: 13/452,210

(22) Filed: Apr. 20, 2012

(51) Int. Cl.
*A61J 9/00* (2006.01)

(52) U.S. Cl.
CPC ..... *A61J 9/005* (2013.01)

(58) Field of Classification Search
CPC ..... A61J 9/00; A61J 9/06
USPC ..... 215/11.1–11.3
See application file for complete search history.

(56) References Cited

U.S. PATENT DOCUMENTS 3,955,698 A * 5/1976 Hammer ..... 215/11.3
4,073,192 A 2/1978 Townsend
4,700,856 A 10/1987 Campbell et al.
4,813,556 A 3/1989 Lawrence
4,928,848 A 5/1990 Ballway
4,979,629 A 12/1990 Askerneese
5,033,631 A 7/1991 Nightingale
5,109,996 A 5/1992 Sullivan
5,356,016 A * 10/1994 Wiedemann ..... 215/11.3
5,524,783 A 6/1996 Popoff
5,642,831 A 7/1997 Lynd
5,685,447 A 11/1997 Springett et al.
5,687,861 A 11/1997 Wiedemann

OTHER PUBLICATIONS

Playtex. Playtex Drop-Ins System. http://www.playtexbaby.com/Bottles/Dropins.

* cited by examiner

*Primary Examiner* — Anthony Stashick
*Assistant Examiner* — Raven Collins
(74) *Attorney, Agent, or Firm* — Robert C. Montgomery; Montgomery Patent & Design LP.

(57) ABSTRACT

An infant bottle with a collapsing insert comprises a cylindrical bottle providing a vertically-positionable supporting platform which acts upon the insert to remove trapped air prior to feeding. The bottle also comprises conventional portions including a cylindrical body, a threaded top opening, a nipple, an attachment ring, and a sanitary cap. The supporting platform is vertically moveable within the interior of the bottle being positioned and locked into position via a pair of spring-loaded buttons which protrude from opposing side surfaces. A user may depress the buttons, vertically relocate the supporting platform to remove trapped air, and lock said supporting platform in position by releasing the buttons.

8 Claims, 6 Drawing Sheets

BOTTLE WITH VOLUMETRIC DISPLACEMENT MEANS

RELATED APPLICATIONS

There are currently no applications co-pending with the present application.

FIELD OF THE INVENTION

The present invention relates generally to infant bottles, and in particular, to infant bottles which include a mechanism for reducing the presence of air inside the liner of the bottle.

BACKGROUND OF THE INVENTION

Infant bottles are well known for feeding infants and toddlers. Many infant bottles include a liner to provide trouble-free cleanup. The liners normally obtain air pockets within the empty space which forms between the underside of the nipple and the top surface of the liquid, even if fully filled. As a result, the baby tends to ingest the air from the bottle, creating the need for the parent to perform excessive burping operations.

Various attempts have been made to provide a bottle with air displacement means. Examples of these attempts can be seen by reference to several U.S. patents. U.S. Pat. No. 5,033,631, issued in the name of Nightingale, describes a device for expelling air from a liner in a baby bottle.

U.S. Pat. No. 5,524,783, issued in the name of Popoff, describes a device for expelling air from a liner in a baby bottle.

U.S. Pat. No. 5,687,861, issued in the name of Wiedemann, describes a compressible baby bottle.

While these devices fulfill their respective, particular objectives, each of these references suffer from one (1) or more disadvantages. Many are not suited to release enough of the air pockets. While others infant bottles with a displacement means are not use friendly. Accordingly, there exists a need for bottle with air displacement means without the disadvantages as described above. The development of the present invention substantially departs from the conventional solutions and in doing so fulfills this need.

SUMMARY OF THE INVENTION

The inventor has recognized the aforementioned inherent problems and lack in the art and observed that there is a need for a bottle with air displacement means.

Accordingly, it is an object of the present embodiments of the invention to solve at least one (1) of these problems. The inventor has addressed this need by developing a bottle with air displacement means which releases air pockets and is user friendly.

To achieve the above objectives, it is an object of the present invention to provide a bottle assembly.

Another object of the present invention is to provide the bottle assembly with a body.

Yet still another object of the present invention is for the bottle assembly to comprise a bottle, an adjustable platform, and a plurality of locking buttons.

Yet still another object of the present invention is to provide the locking buttons as spring biased posts which ride within slots upon a body of the bottle assembly.

Yet still another object of the present invention is to provide the adjustable platform with a domed profile.

Yet still another object of the present invention is to provide the bottle assembly with a nipple and nipple flange.

Yet still another object of the present invention is to provide the bottle assembly with a body.

Yet still another object of the present invention is to provide a method of utilizing the device that provides a unique means of utilizing the body, utilizing the adjustable platform, engaging the locking buttons, and positioning to a desired position to compress an insert within the body.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
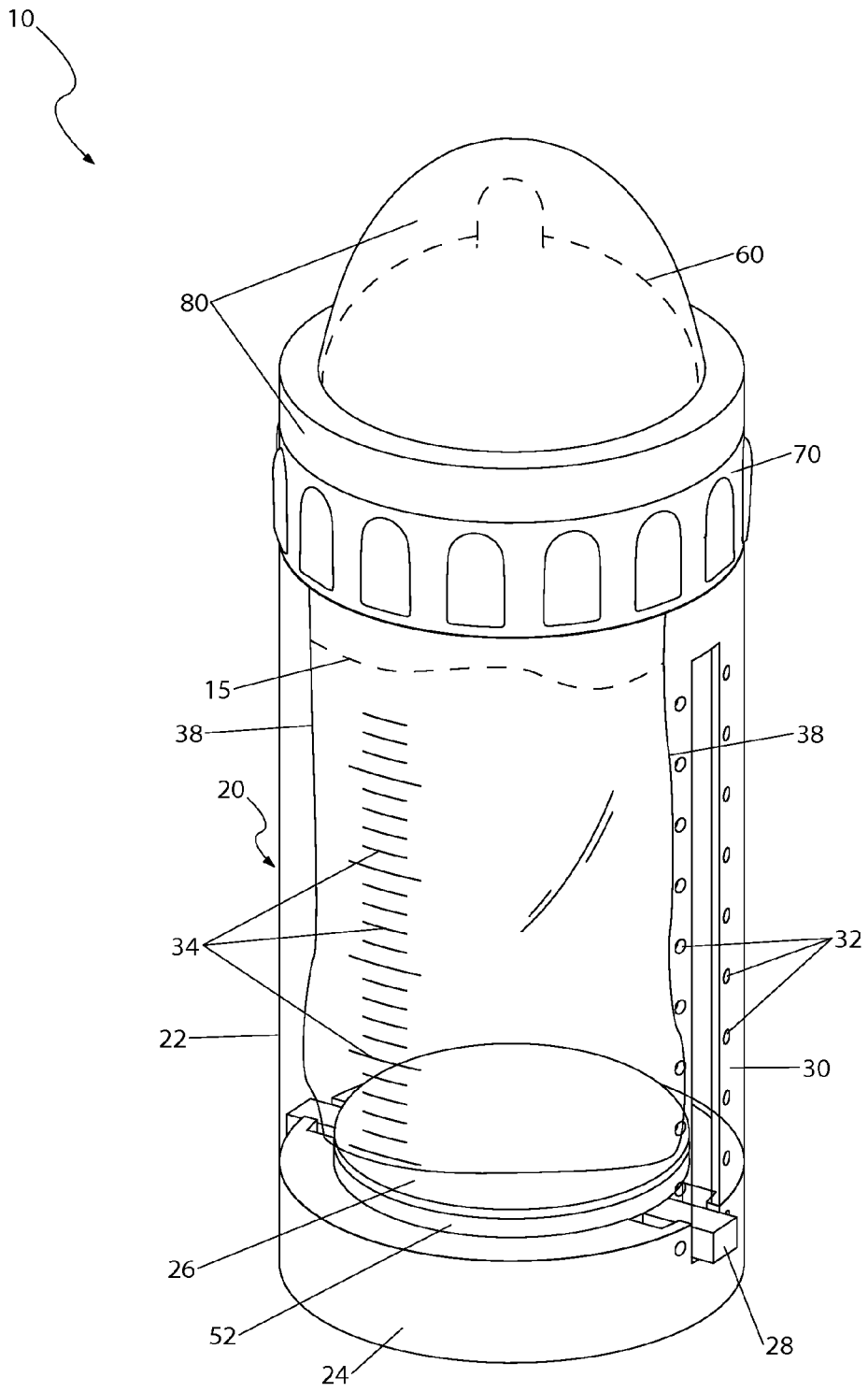
FIG. 1 is a front perspective view of a bottle with volumetric displacement means 10, according to a preferred embodiment of the present invention.

10 bottle with volumetric displacement means
15 liquid
20 bottle assembly
22 body
23 male threaded portion
24 base
25 inner cavity
26 adjustable platform
28 locking button
30 slot
32 locking aperture
34 graduation mark
38 collapsible insert
39 first insert flange
40 locking post
42 guide aperture
52 platform support member
54 spring post
56 spring
60 nipple
62 nipple flange
64 nipple orifice
70 attachment ring
72 female threaded portion
74 gripping surface
80 cap
102 cup insert
104 second insert flange

DETAILED DESCRIPTION OF THE PREFERRED EMBODIMENT

Figure 4:
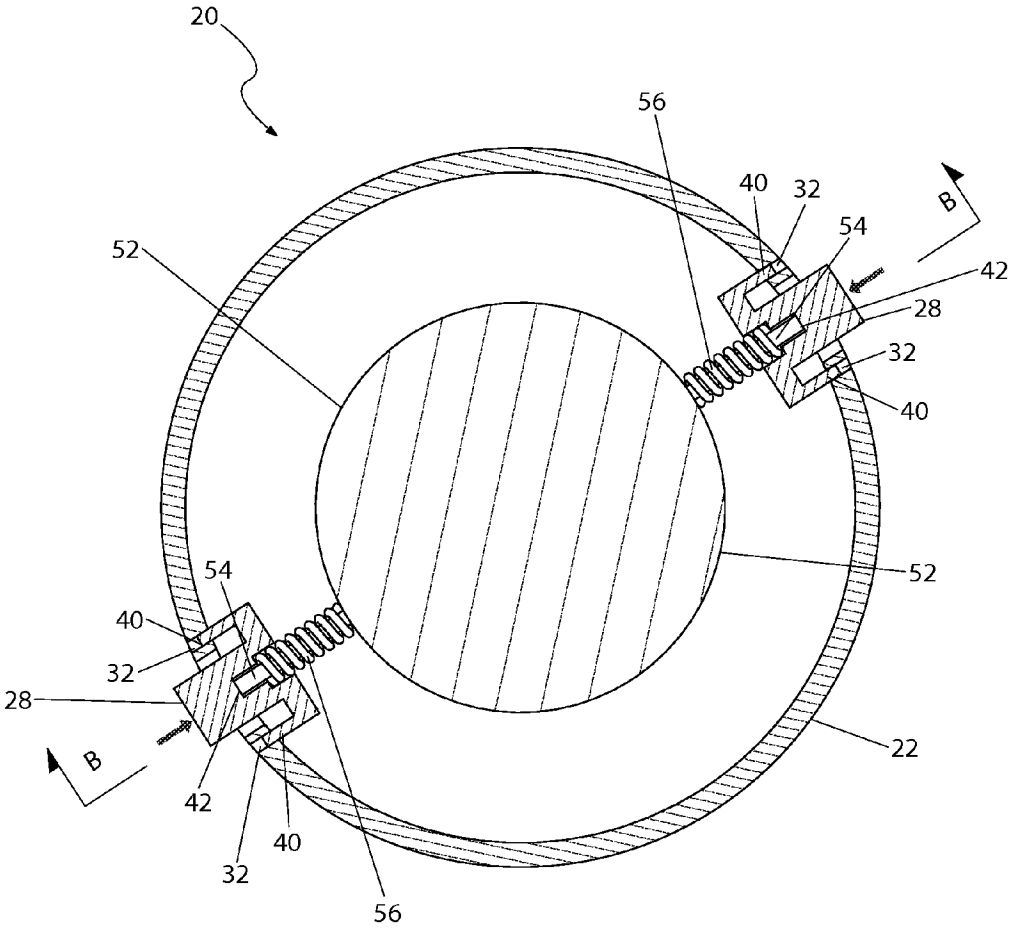
FIG. 4 is a section view of the bottle assembly 20 taken along section line A-A (see FIG. 3), according to a preferred embodiment of the present invention.
Figure 5:
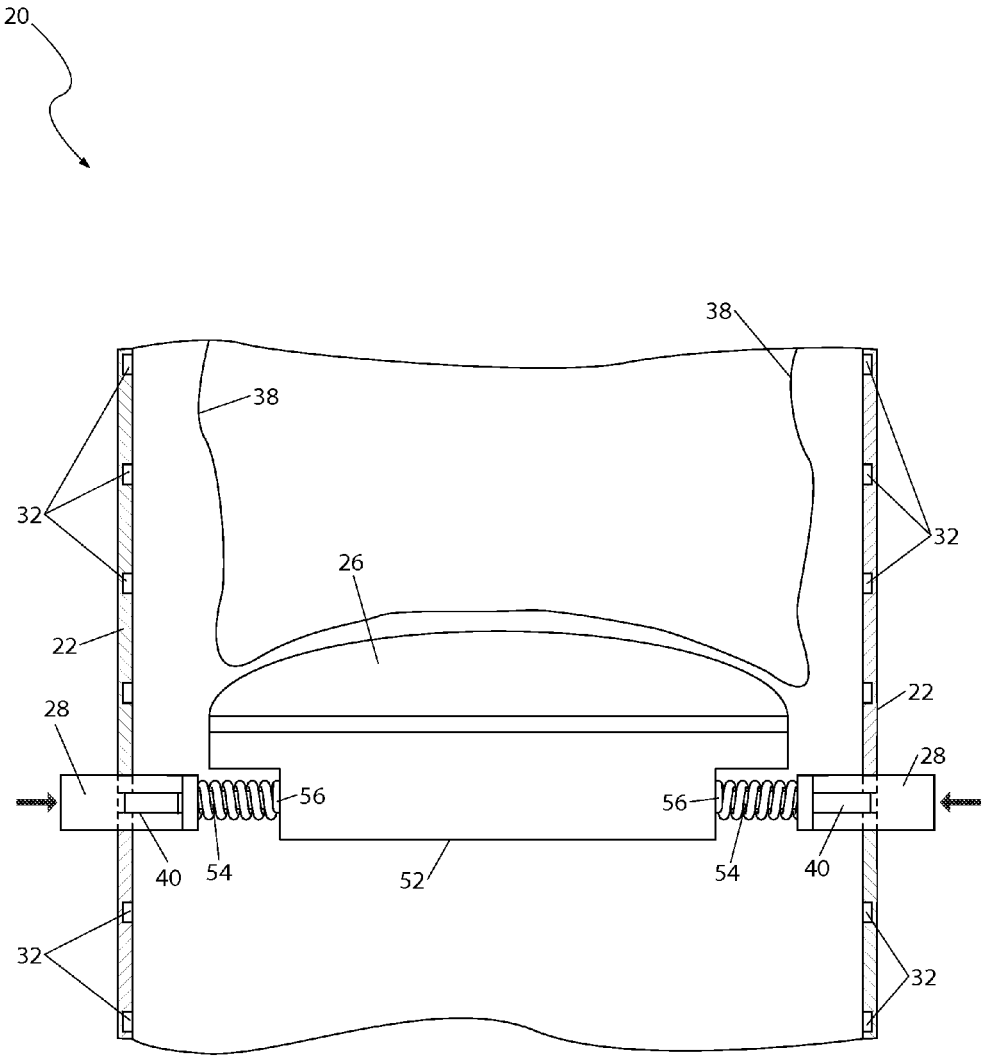
FIG. 5 is a section view of the bottle assembly 20 taken along section line B-B (see FIG. 4), according to a preferred embodiment of the present invention; and, FIG. 6 is a front perspective view of a cup insert 102, according to an alternate embodiment of the invention.
Figure 6:
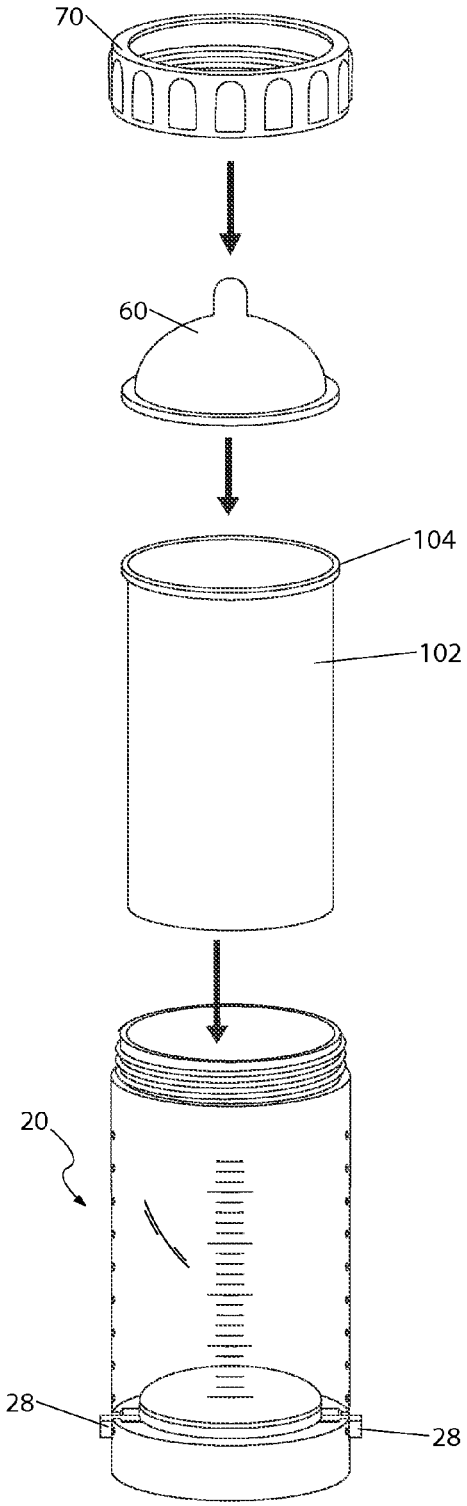

The best mode for carrying out the invention is presented in terms of its preferred embodiment, herein depicted within FIGS. 1 through 5 and in terms of an alternate method of use, herein depicted within FIG. 6. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a bottle with volumetric displacement means (herein described as the "apparatus") 10, which provides a baby feeding bottle 20 which utilizes a disposable collapsible insert 38 with an integral mechanism to compress a bottom portion of said collapsible insert 38, thereby reducing a volume of air inside. Said collapsing mechanism is integral to a cylindrical body portion 22 of the apparatus 10 and further comprises a pair of opposed locking buttons 28 which allow a user to incrementally elevate an internal adjustable platform 26 which drives the collapsible insert 38 upwardly, thereby forcing excess air within said collapsible insert 38 out of the nipple 60 prior to consumption of the contained liquid 15. The apparatus 10 further comprises conventional and expected portions including a cylindrical bottle body 22, a nipple 60, an attachment ring 70, and a sanitary cover cap 80.

Figure 2:
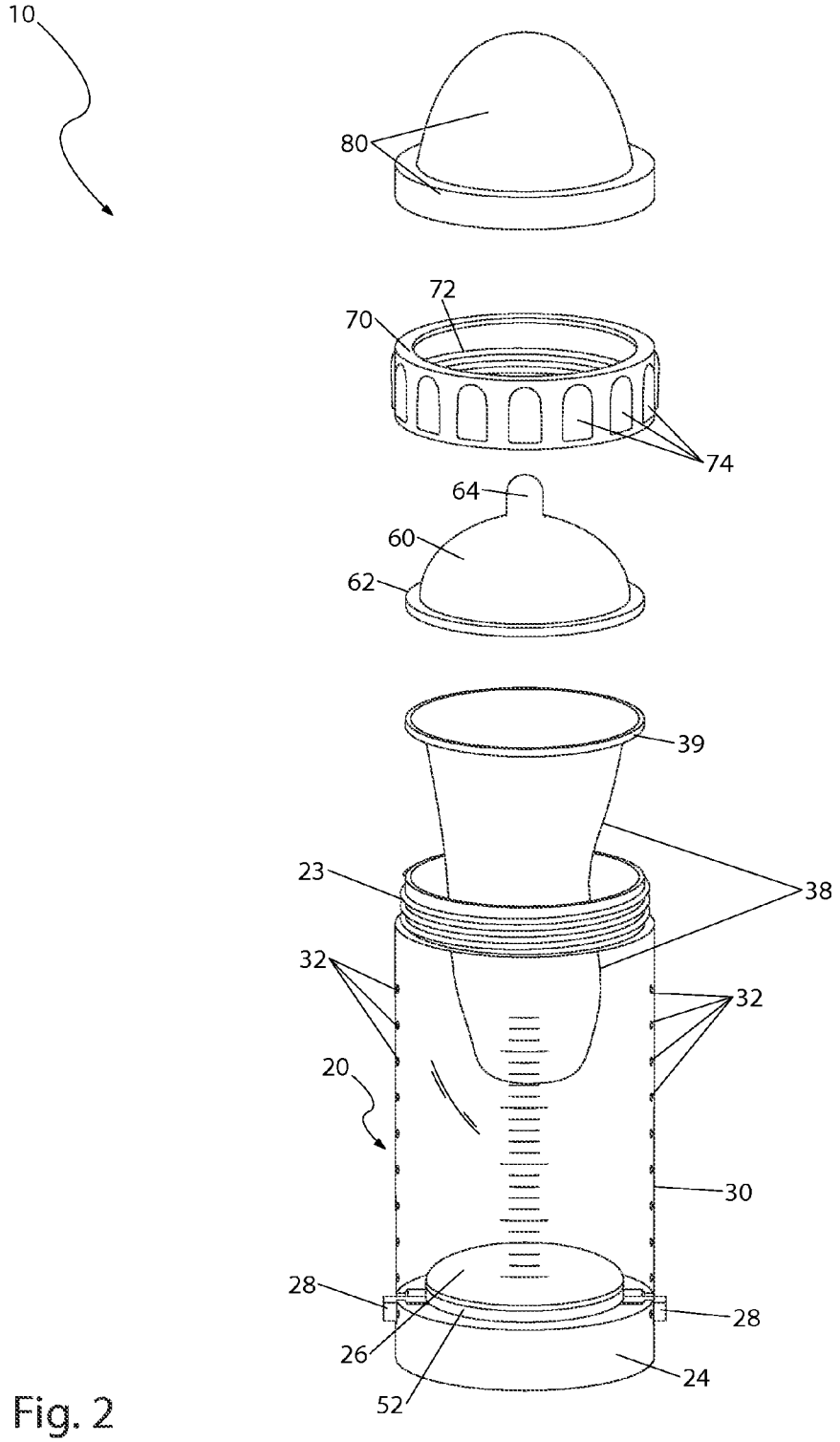
FIG. 2 is an exploded view of the bottle with volumetric displacement means 10, according to a preferred embodiment of the present invention.

Referring now to FIGS. 1 and 2, front perspective and exploded views of the apparatus 10, according to a preferred embodiment of the present invention, are disclosed. The apparatus 10 comprises a bottle assembly 20, a collapsible insert 38, a nipple 60, an attachment ring 70, and a cap 80. The bottle assembly portion 20 of the apparatus 10 further comprises a transparent cylindrical bottle body 22 providing easy visual communication of a remaining volume of contained liquid 15 via molded-in and/or painted graduation markings 34 along an outer side surface. Said bottle assembly 20 also provides a vertically adjustable platform 26 onto which the collapsible insert 38 rests. Said adjustable platform 26 provides a means to compress the collapsible insert 38 as it is incrementally raised above an integral protective plastic base portion 24 of said bottle assembly 20. Said adjustable platform 26 is vertically positioned and locked in place via mechanical communication with a pair of opposing locking buttons 28 which are spring-biased outwardly through respective slot portions 30 formed within side surfaces of the bottle body 22. As a user presses both locking buttons 28 inwardly, the adjustable platform 26 is free to move vertically to expel air from the collapsible insert 38 or return to a bottom start position, respectively. The adjustable platform 26 comprises an upwardly domed profile which matches that of the nipple 60 so as to more completely displace the collapsable insert 38 as well as the contained liquid 15. The adjustable platform 26 may be secured at a desired height by vertically positioning and releasing the locking buttons 28. Each locking button 28 in turn mechanically engages a pair of locking apertures 32 being correspondingly formed within a wall portion of said bottle body 22. Said locking apertures 32 are arranged in two (2) parallel vertical rows on each side of said slot portion 30 (see FIGS. 3,4, and 5).

The collapsible insert 38 provides a cylindrical collapsing structure having a first insert flange 39 along an upper perimeter edge which collapses during feeding an infant the contained liquid 15 in a similar manner as PLAYTEX DROP-INS®. The nipple 60 further comprises a conventional design having a perimeter nipple flange 62 and an upwardly protruding nipple orifice 64. The attachment ring 70 further comprises an internal female threaded portion 72 and an ergonomic gripping surface 74 along a perimeter outer surface. The apparatus 10 is envisioned to be made of transparent or translucent food-grade plastic materials and introduced in a variety of attractive colors. Furthermore, the apparatus 10 is envisioned being made available having various internal fluid volumes such as, but not limited to: six (6), eight (8), and twelve (12) ounces.

Assembly of the apparatus 10 is accomplished by inserting the collapsible insert 38 into an inner cavity portion 25 of the bottle body 22 so as to cause the first insert flange 39 to rest upon a male threaded portion 23 of said bottle body 22. The nipple flange portion 62 of the nipple 60 is subsequently stacked upon said first insert flange 39 and the female threaded portion 72 of the attachment ring 70 is threadingly engaged and tightened against the corresponding male threaded portion 23 of the bottle body 22 to seal the bottle body 22, collapsible insert 38, and nipple 60 to each other. The cap 80 comprises a conventional dome-shaped snap-on protective device when the apparatus 10 is not in use which engages an outer surface of the attachment ring 70 via a friction fit.

Figure 3:
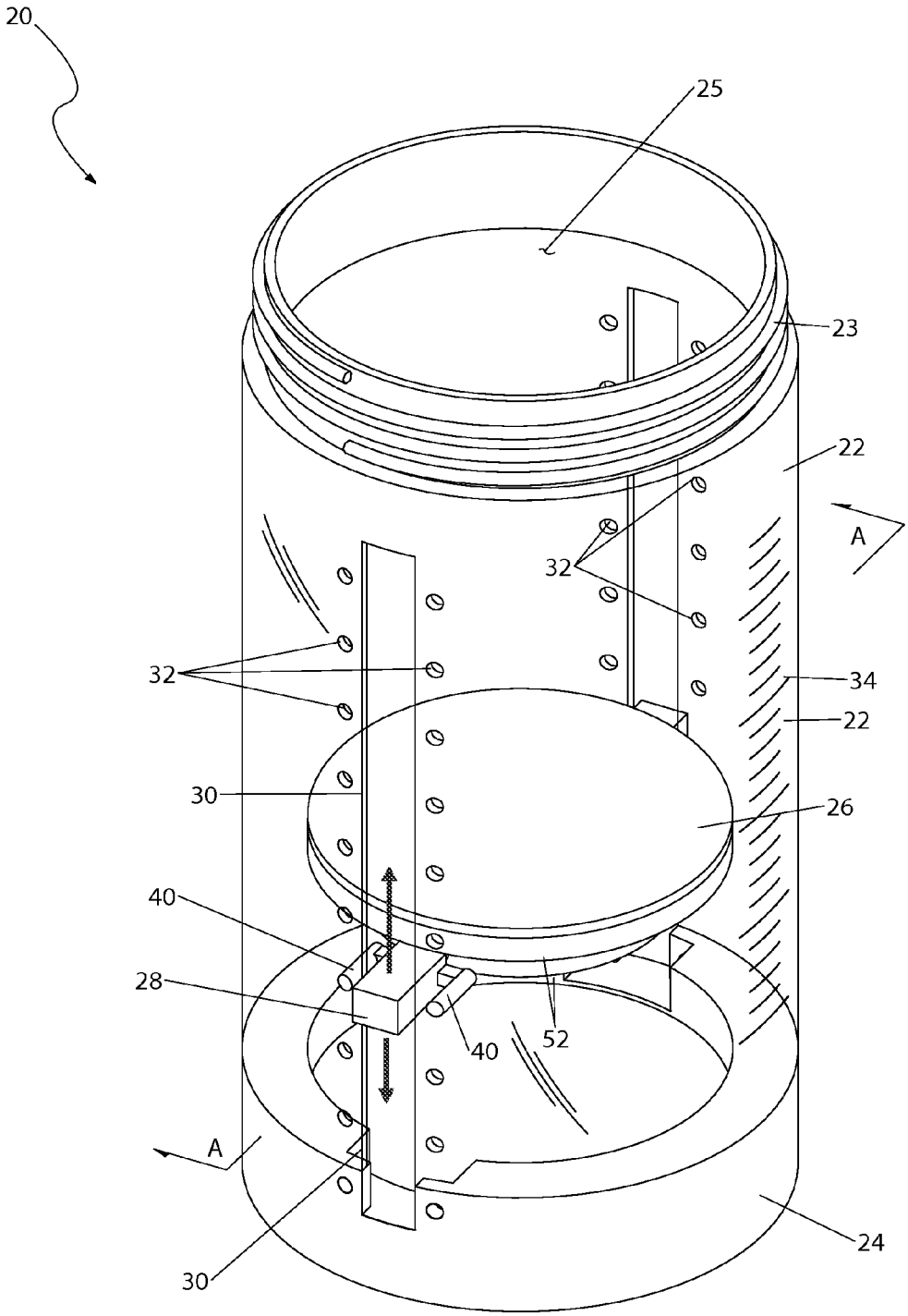
FIG. 3 is a close-up perspective view of the bottle assembly 20, according to a preferred embodiment of the present invention.

Referring now to FIGS. 3, 4, and 5, close-up and section views of the bottle assembly portion 20 of the apparatus 10, according to a preferred embodiment of the present invention, are disclosed. The apparatus 10 provides a mechanism to position and secure the adjustable platform 26 at a desired vertical location via the two (2) locking buttons 28. Each locking button 28 further comprises a pair of integral locking posts 40 being formed along inwardly-facing side surfaces in a "U"-shaped manner and having cylindrically-shaped end portions which are correspondingly positioned to insertingly engage respective locking aperture portions 32 formed within an internal surface of the bottle body 22 and being arranged along both side edges of the aforementioned slot 30.

The locking buttons 28 supported and adjust the adjustable platform 26. Said adjustable platform 26 comprises a circular-shaped disc-like member having a diameter slightly less than an inner diameter of the bottle body 22, thereby forming a plunger-like mechanism. Said adjustable platform 26 further comprises a subjacent and indented circular platform support member 52 which provides an attachment means to the locking buttons 28 via respective outwardly extending spring posts 54. Said spring posts 54 comprise integrally-molded cylindrical appendages which extend outwardly from side surfaces of the platform support member 52. Said spring posts 54 are slidingly inserted into respective guide aperture portions 42 within each locking button 28. Said spring posts 54 are further encompassed by respective compression springs 56 which act against said locking buttons 28 to bias said locking buttons 28 in an outward direction, thereby causing the aforementioned locking posts 40 to forceably engage respective locking apertures 32.

Referring now to FIG. 6, a front perspective view of the cup insert 102, according to an alternate method of use of the invention, is disclosed. The cup insert 102 comprises a semi-rigid cylindrical body member with an open top designed to maintain a cylindrical shape during feeding of a contained liquid 15. Said cup insert 102 further comprises an upper perimeter second insert flange 104 which provides a sealing means similar to the previously described first insert flange 39. The cup insert 102 may be utilized in lieu of the previously described collapsible insert 38 upon such time as an infant no longer requires the collapsing function of the collapsible insert 38. Said cup insert 102 comprises a cylindrical shape having an outer diameter which may be slidingly inserted into an inner cavity portion 25 of the bottle body 22 such that the second insert flange 104 rests upon the male threaded portion 23 of said bottle body 22. Subsequently, the nipple 60 and attachment ring 70 are affixed in a conventional manner.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of configuring and utilizing the preferred embodiment of the apparatus 10 may be achieved by performing the following steps: procuring a model of the apparatus 10 having a desired fluid volume and color; removing the attachment ring 70 and nipple 60, if previously installed; inserting the collapsible insert 38 into the inner cavity portion 25 of the bottle body 22 until the first insert flange 39 is resting on the male threaded portion 23 of the bottle body 22; filling the collapsible insert 38 with a liquid beverage 15; threadingly installing the nipple 60 and attachment ring 70 in a conventional manner; holding the apparatus 10 vertically with the nipple 60 pointing in an upward direction; depressing both locking buttons 28 to operably motion the adjustable platform 26 upwardly in a plunger-like manner to force a desired amount of air from the collapsible insert 38 and out the nipple orifice portion 64 of the nipple 60 prior to feeding; feeding the liquid 15 to the infant in a conventional manner; preventing air pockets from re-forming within the collapsible insert 38 as a vacuum created inside said collapsible insert 38 causes said collapsible insert 38 to collapse; and, preventing a child from ingesting excessive air during feeding using the present invention 10.

The alternate method of use provides feeding of a maturing infant using an internal cup structure 102 at such time the infant progresses beyond a need for the air reduction function of the collapsing insert 38. The method of configuring and utilizing the cup insert 102 may be achieved by performing the following steps: inserting the semi-rigid cup insert 102 into the inner cavity portion 25 of the bottle body 22 in lieu of the collapsible insert 38; filling the cup insert 102 with a desired liquid 15 beverage; threadingly installing the nipple 60 and attachment ring 70 in a conventional manner; feeding the liquid 15 to the infant in a conventional manner.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A baby feeding apparatus comprising: a bottle assembly comprising:

a body having a base portion, further comprising:

a plurality of slots formed therein;

a pair of integral locking posts located within said body and having "U"-shapes respectively; and, a plurality of locking apertures formed within an internal surface of said body, said locking apertures arranged along opposed side edges of said slots respectively;

wherein said locking posts are insertingly engaged with respective ones of said locking apertures;

an adjustable platform located within said body;

a plurality of locking buttons engaged with said body and said adjustable platform in such a manner that said adjustable platform is selectively locked within said body; and, a collapsible insert supported on said adjustable platform and positioned within said body in such a manner that said collapsible insert is compressed within said body when said adjustable platform is incrementally raised above said base portion;

wherein said locking buttons are spring-biased outwardly through said slots; and, wherein inward displacement of said locking buttons freely moves said adjustable platform along a vertical path within said body and thereby expels air from said collapsible insert.

2. The baby feeding apparatus of claim 1, wherein said adjustable platform comprises an upwardly domed profile.

3. The baby feeding apparatus of claim 1, further comprising: a nipple having a nipple flange portion;

wherein said collapsible insert includes a first insert flange disposed along an upper perimeter edge thereof, said nipple flange portion be stacked on said first insert flange.

4. The baby feeding apparatus of claim 1, wherein said adjustable platform further comprises:

a subjacent and indented platform support member provided with a plurality of spring posts slidingly inserted into said locking buttons; and, a plurality of springs positioned about said spring posts thereby biasing said locking buttons in an outward direction and causing said spring posts to forcibly engage said locking apertures respectively;

wherein said spring posts extend outwardly from said platform support member.

5. A baby feeding apparatus comprising: a bottle assembly comprising:

a body having a base portion, further comprising:

a plurality of slots formed therein;

a pair of integral locking posts located within said body and having "U"-shapes respectively; and, a plurality of locking apertures formed within an internal surface of said body, said locking apertures arranged along opposed side edges of said slots respectively;

wherein said locking posts are insertingly engaged with respective ones of said locking apertures;

an adjustable platform slidably located within said body;

a plurality of locking buttons engaged with said body and said adjustable platform in such a manner that said adjustable platform is vertically positioned and selectively locked within said body; and, a collapsible insert supported on said adjustable platform and positioned within said body in such a manner that said collapsible insert is compressed within said body when said adjustable platform is incrementally raised above said base portion;

wherein said locking buttons are spring-biased outwardly through said slots; and, wherein inward displacement of said locking buttons freely moves said adjustable platform along a vertical path within said body and thereby expels air from said collapsible insert.

6. The baby feeding apparatus of claim 5, wherein said adjustable platform comprises an upwardly domed profile.

7. The baby feeding apparatus of claim 5, further comprising: a nipple having a nipple flange portion;

wherein said collapsible insert includes a first insert flange disposed along an upper perimeter edge thereof, said nipple flange portion be stacked on said first insert flange.

8. The baby feeding apparatus of claim 5, wherein said adjustable platform further comprises:

a subjacent and indented platform support member provided with a plurality of spring posts slidingly inserted into said locking buttons; and, a plurality of springs positioned about said spring posts thereby biasing said locking buttons in an outward direction and causing said spring posts to forcibly engage said locking apertures respectively;

wherein said spring posts extend outwardly from said platform support member.

* * * * *